US006596683B1

(12) United States Patent
Ebihara et al.

(10) Patent No.: US 6,596,683 B1
(45) Date of Patent: Jul. 22, 2003

(54) PROCESS FOR PREPARING A GRANULAR DETERGENT COMPOSITION

(75) Inventors: Fukuji Ebihara, Kobe (JP); Tatsuo Gobayashi, Osaka (JP); Takashi Kazuta, Kobe (JP)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/868,260

(22) PCT Filed: Dec. 22, 1998

(86) PCT No.: PCT/US98/27271

§ 371 (c)(1),
(2), (4) Date: Jun. 15, 2001

(87) PCT Pub. No.: WO00/37604

PCT Pub. Date: Jun. 29, 2000

(51) Int. Cl.[7] ..... C11D 11/00
(52) U.S. Cl. ..... 510/441; 510/442; 510/444
(58) Field of Search ..... 510/441, 442, 510/444

(56) References Cited

U.S. PATENT DOCUMENTS

| | | | | | |
|---|---|---|---|---|---|
| 3,231,506 | A | * | 1/1966 | Schulerud | 510/298 |
| 3,816,319 | A | | 6/1974 | Sarot et al. | |
| 3,989,635 | A | | 11/1976 | Toyoda et al. | |
| 4,105,827 | A | | 8/1978 | Brichard et al. | 428/403 |
| 4,846,409 | A | | 7/1989 | Kaspar et al. | |
| 4,919,847 | A | | 4/1990 | Barletta et al. | |
| 5,108,646 | A | | 4/1992 | Beerse et al. | |
| 5,478,488 | A | | 12/1995 | Doetsch et al. | |
| 5,501,810 | A | * | 3/1996 | Eugster et al. | 510/442 |
| 5,576,285 | A | | 11/1996 | France et al. | 510/444 |
| 5,707,953 | A | | 1/1998 | Van't Land et al. | 510/375 |
| 5,916,868 | A | | 6/1999 | Mazzola et al. | 510/444 |

FOREIGN PATENT DOCUMENTS

| | | | | |
|---|---|---|---|---|
| DE | 44 35 743 | A1 | | 8/1995 |
| DE | 196 51 446 | | | 6/1998 |
| DE | 197 13 328 | A1 | | 10/1998 |
| EP | 0 057 611 | A2 | | 8/1982 |
| EP | 0 353 976 | A1 | | 2/1990 |
| EP | 0 570 881 | A2 | | 11/1993 |
| EP | 0 651 053 | A1 | | 5/1995 |
| WO | WO 94/24260 | A1 | | 10/1994 |
| WO | WO 97/12955 | A1 | | 4/1997 |
| WO | WO 97/22685 | A1 | | 6/1997 |
| WO | WO 97/28246 | A1 | | 8/1997 |
| WO | WO 97/42300 | A1 | * | 11/1997 |
| WO | WO 99/00475 | A1 | | 1/1999 |

* cited by examiner

*Primary Examiner*—Lorna M. Douyon
(74) *Attorney, Agent, or Firm*—Brian M. Bolam; Kim William Zerby; Steven W. Miller

(57) ABSTRACT

Disclosed is a process for making a granular detergent composition comprising the steps of: (a) granulating a detersive material comprising a detergent surfactant and a builder; and (b) coating an inorganic aqueous solution on the granules substantially to coat the granules.

5 Claims, No Drawings

PROCESS FOR PREPARING A GRANULAR DETERGENT COMPOSITION

FIELD

The present invention relates to a process for preparing a detergent composition having improved solubility and improved physical properties.

BACKGROUND

There is a current trend for commercially available granular detergent compositions that have higher bulk densities as well as higher active ingredient content. Such granular detergent compositions offer greater convenience to the consumer and reduce the amount of packaging materials which will ultimately be disposed of.

In view of manufacturing of the compositions, a main concern over the years is to provide granular detergent compositions that exhibit good solubility in various wash water conditions, particularly in cold water, as well as good physical properties such as preferable bulk density and improved flowability. Recently, this concern has become important in the field with the proliferation of higher density "compact" detergents, e.g., granular detergent compositions having bulk densities of 600 g/l or higher. Poor solubility of granular detergent compositions may cause, for example, clumps of granules that appear as solid white masses remaining in the washing machine and/or on washed clothes. In particular, such clumps of granules tend to occur in cold wash water conditions and/or when the order of addition to the washing machine is laundry detergent first, clothes second, and water last.

Various approaches to improving the solubility of detergent compositions have previously been taken by detergent manufacturers. One approach is to spray nonionic surfactant over the surfaces of spray-dried detergent beads. The nonionic surfactant is used as a binder between spray-dried detergent beads and Zeolite generally used for coating the detergent beads. As Zeolite is dried particles, Zeolite tends to use for separating detergent particles as well as provides good solubility of detergent composition. See, U.S. Pat. No. 5,565,422, Del Greco et al., issued Oct. 27, 1996, disclosing a process for making a granular detergent composition comprising the step of spraying a nonionic surfactant onto spray-dried detergent granules. Such detergent provides improved solubility and flowability.

However, such particles of granular detergent compositions, each of which is coated by nonionic surfactants, tend to stick together, resulting in the formation of large particles. The stickiness of nonionic surfactant may be caused by premature dissolution. For example, when the granular detergent compositions coated by nonionic surfactants are exposed to humidity or contacted with water, the nonionic surfactants start to dissolve first, changing their form to that of a gel-like substance, and finally becoming sticky. The sticky, gel-like formation of the nonionic surfactants on the surface of granular detergent particles tends to perform masking/covering of the detergent particles to prevent dissolution of detergent particles, particularly to prevent the dissolution of detergent slurry located inside of the granular particles. In addition, the stickiness tends to proceed agglomeration of the particles, resulting in increased caking of the granular detergent composition during the remainder of processing, after preparing granules, and in storage.

It would therefore be desirable to improve gel solubility of granular detergent compositions, e.g., prevent gel forming during processing and in storage, as well as maintaining physical properties such as good free flowability and providing low density granules.

Based on the foregoing, there is a need for a process which provides a granular detergent composition having improved solubility and improved physical properties. None of the existing art provides all of the advantages and benefits of the present invention.

SUMMARY

The present invention is directed to process for making a granular detergent composition comprising the steps of:

(a) granulating a detersive material comprising a detergent surfactant and a builder; and (b) coating an inorganic aqueous solution on the granules to substantially coat the granules.

These and other features, aspects, and advantages of the present invention will become better understood from a reading of the following description, and appended claims.

DETAILED DESCRIPTION

While the specification concludes with claims particularly pointing out and distinctly claiming the invention, it is believed that the present invention will be better understood from the following description.

All percentages, ratios, and levels of ingredients referred to herein are based on the actually total amount of the composition, unless otherwise indicated.

All measurements referred to herein are made at 25° C. unless otherwise specified.

All publications, patent applications, and issued patents mentioned herein are hereby incorporated in their entirety by reference. Citation of any reference is not an admission regarding any determination as to its availability as prior art to the claimed invention.

Herein, "comprising" means that other steps and other ingredients which do not affect the end result can be added. This term encompasses the terms "consisting of" and "consisting essentially of."

Herein, "mixtures" is meant to include a simple combination of materials and any compounds that may result from their combination.

Herein, "cold water" means water which has at a temperature of below 30° C.

Herein, "density" means bulk density unless specifically stated otherwise.

All ingredients such as detersive surfactants and builders useful herein may be categorized or described by their benefit or their postulated mode of action. However, it is to be understood that the ingredients useful herein can, in some instances, provide more than one benefit or operate via more than one mode of action. Therefore, classifications herein are made for the sake of convenience and are not intended to limit an ingredient to the particularly stated application or applications listed.

The present invention is directed to a process for preparing a granular detergent composition comprising the steps of: granulating a detersive material comprising a detergent surfactant and a builder; and coating an inorganic aqueous solution on the granules to substantially coat the granules.

The granular detergent composition prepared by the process of the present invention provides improved solubility of detergent compositions, e.g., by coating of the aqueous inorganic that prevents gel-like formation of particulate granules in the remainder of processing, after preparing granules, and in storage. The improved solubility can be detected by evidence of increased solubility of the surfactants in the washing solution, by the decreased amount of granular detergent left on laundered clothes, and/or by substantially no caking in the stored package.

The composition prepared by the process herein can also provide good physical properties such as free flowability and high density to the granules. Improved free flowability can provide no caking and no lumps in product so as to be easy to use, e.g., to scoop and measure the detergent. The composition prepared by the present invention can provide increased bulk density, particularly increasing 50 to 70 g/l more (the range of conventional compact detergent is about 600 to 800 g/l), resulting in producing more a compact detergent product to the consumer. The composition which is more compact but has no caking and good solubility can make use of the detergent easier for the consumers.

It is believed that surfactants, particularly nonionic surfactants, contained in detersive materials, which change the form to gel when exposed to humidity or when contacted with water, tend to permeate coming out of the granules. In addition, the surfactant which coats the detergent beads may perform as well (binding detergent particles by gelled surfactants). The surfactant turned to gel-like formation makes each particulate stick together to form large agglomerates. Furthermore, such gelled surfactants may mask the each particulate, e.g., substantially cover the detersive material, resulting in preventing dissolution of the detersive material. It is also believed that inorganic aqueous solutions used in the process of the present invention have good water solubility, therefore tending to smoothly dissolve when exposed to humidity and facilitating dissolution of the composition.

A. Granulating Step

The first step for preparing granular detergent composition of the present invention is granulating a detersive material comprising a detergent surfactant and a builder. Any known processes conventionally used for preparing granules, various means and equipment are available. Preferably, the detersive material is applied by the form of an aqueous slurry. Herein, "slurry" refers to a mixture of a detergent surfactant and a builder, which is not substantially solid form. The slurry can also include other ingredients such as brighteners and buffers.

Spray-drying for slurry mixtures, preferably for aqueous slurry mixtures to form spray-dried granules, is preferable. More preferably, spray-drying in relatively tall spray drying towers is useful. Preferably, the spray drying process useful herein includes dispersing an aqueous slurry or mixture under high pressure through nozzles down a spray drying tower through which hot gases are counter-currently flowing up the tower. This step can be carried out in conventional spray drying equipment such as the aforementioned towers as well as other spray drying apparatus. The spray-dried granules, that are subsequently used as part of the overall process then can be compacted by a compacting machine. The aqueous slurry used comprises the anionic surfactant, the builder, and no more than about 1.0%, preferably about 0%, by weight of nonionic surfactant. The amount of nonionic surfactant in the aqueous slurry is based on limitations concerning environmental and safety concerns (plume opacity, auto-oxidation) and limitations concerning the physical properties of the slurry used during the spray drying process.

Spray-dried granules from a tower also can be densified further by loading a liquid such as water or a nonionic surfactant into the pores of the granules and/or subjecting them to one or more high speed mixer/densifiers. A suitable high speed mixer/densifier for this process is a device marketed under the tradename "Lödige CB 30" or "Lödige CB 30 Recycler" which comprises a static cylindrical mixing drum having a central rotating shaft with mixing/cutting blades mounted thereon. In use, the ingredients for the composition are introduced into the drum and the shaft/blade assembly is rotated at speeds in the range of 100–2500 rpm to provide thorough mixing/densification. See U.S. Pat. No. 5,149,455, Jacobs et al, issued Sep. 22, 1992, and U.S. Pat. No. 5,565,422, Del Greco et al, issued Oct. 15, 1996. Other such apparatus includes the devices marketed under the tradename "Shugi Granulator" and under the tradename "Drais K-TTP 80".

Another process step which can be used to further densify spray-dried granules involves treating the spray-dried granules in a moderate speed mixer/densifier. Equipment such as that marketed under the tradename "Lödige KM" (Series 300 or 600) or "Lödige Ploughshare" mixer/densifiers are suitable for this process step. Such equipment is typically operated at 40–160 rpm. The residence time of the detergent ingredients in the moderate speed mixer/densifier is from about 0.1 to 12 minutes conveniently measured by dividing the steady state mixer/densifier weight by the throughput (e.g., Kg/hr). Other useful equipment includes the device which is available under the tradename "Drais K-T 160." This process step which employs a moderate speed mixer/densifier (e.g., Lödige KM) can be used by itself or sequentially with the aforementioned high speed mixer/densifier (e.g., Lödige CB) to achieve the desired density. Other types of granules manufacturing apparatus useful herein include the apparatus disclosed in U.S. Pat. No. 2,306,898, G. L. Heller, issued Dec. 29, 1942.

While it may be more suitable to use the high speed mixer/densifier followed by the low speed mixer/densifier, the reverse sequential mixer/densifier configuration also can be used. One or a combination of various parameters including residence times in the mixer/densifiers, operating temperatures of the equipment, temperature and/or composition of the granules, the use of adjunct ingredients such as liquid binders and flow aids, can be used to optimize densification of the spray-dried granules in the process of the invention. By way of example, see the processes in U.S. Pat. No. 5,133,924, Appel et al, issued Jul. 28, 1992; U.S. Pat. No. 4,637,891, Delwel et al, issued Jan. 20, 1987; U.S. Pat. No. 4,726,908, Kruse et al, issued Feb. 23, 1988; and, U.S. Pat. 5,160,657, Bortolotti et al, issued Nov. 3, 1992.

In those situations in which particularly heat sensitive or highly volatile detergent ingredients are to be incorporated into the final detergent composition, processes which do not include spray drying towers are preferred. The formulator can eliminate the spray-drying step by feeding, in either a continuous or batch mode, starting detergent ingredients directly into mixing equipment that is commercially available. One particularly preferred embodiment involves charging a surfactant paste and an anhydrous material into a high speed mixer/densifier (e.g., Lödige CB) followed by a moderate speed mixer/densifier (e.g., Lödige KM) to form high density detergent agglomerates. See U.S. Pat. No. 5,366,652, Capeci et al, issued Nov. 22, 1994 and U.S. Pat. No. 5,486,303, Capeci et al, issued Jan. 23, 1996. Optionally, the liquid/solids ratio of the starting detergent ingredients in such a process can be selected to obtain high density agglomerates that are more free flowing and crisp. See U.S. Pat. No. 5,565,137, Capeci et al, issued Oct. 15, 1996.

Optionally, the process may include one or more recycle streams of undersized particles produced by the process which are fed back to the mixer/densifiers for further agglomeration or build-up. The oversized particles produced by this process can be sent to grinding apparatus and then fed back to the mixing/densifying equipment. These additional recycle process steps facilitate build-up agglomeration of the starting detergent ingredients resulting in a finished composition having a uniform distribution of the desired particle size (400–700 microns) and density (>550 g/l). See U.S. Pat. No. 5,516,448, Capeci et al, issued May 14, 1996 and U.S. Pat. No. 5,489,392, Capeci et al, issued Feb. 6, 1996. Other suitable processes which do not call for the use of spray-drying towers are described by U.S. Pat. No. 4,828,721, Bollier et al, issued May 9, 1989; U.S. Pat. No. 5,108,646, Beerse et al, issued Apr. 28, 1992; and, U.S. Pat. No. 5,178,798, Jolicoeur, issued Jan. 12, 1993.

In yet another embodiment a high density detergent composition using a fluidized bed mixer. In this process, the various ingredients of the finished composition are combined in an aqueous slurry (typically 80% solids content) and sprayed into a fluidized bed to provide the finished detergent granules. Prior to the fluidized bed, this process can optionally include the step of mixing the slurry using the aforementioned Lödige CB mixer/densifier or a "Flexomix 160" mixer/densifier, available from Shugi. Fluidized bed or moving beds of the type available under the tradename "Escher Wyss" can be used in such processes.

Another suitable process which can be used herein involves feeding a liquid acid precursor of an anionic surfactant, an alkaline inorganic material (e.g., sodium carbonate) and optionally other detergent ingredients into a high speed mixer/densifier so as to form particles containing a partially or totally neutralized anionic surfactant salt and the other starting detergent ingredients. Optionally, the contents in the high speed mixer/densifier can be sent to a moderate speed mixer/densifier (e.g., Lödige KM) for further mixing resulting in the finished high density detergent composition. See U.S. Pat. No. 5,164,108, Appel et al, issued Nov. 17, 1992.

Optionally, high density detergent compositions according to the invention can be produced by blending conventional or densified spray-dried detergent granules with detergent agglomerates in various proportions (e.g., a 60:40 weight ratio of granules to agglomerates) produced by one or a combination of the processes discussed herein. See U.S. Pat. No. 5,569,645, Dinniwell et al, issued Oct. 29, 1996. Additional adjunct ingredients such as enzymes, perfumes, brighteners and the like can be sprayed or admixed with the agglomerates, granules or mixtures thereof produced by the processes discussed herein.

(1) Detergent Surfactant

The granular detergent compositions produced by the process of the present invention useful herein comprise from about 5% to about 80%, more preferably from about 10% to about 70%, most preferably from about 15% to about 40%, by weight of the composition, of detergent surfactant.

The detergent surfactant can be selected from the group consisting of anionic surfactants, nonionic surfactants, zwitterionic surfactants, ampholytic surfactants, cationic surfactants, and mixtures thereof; more preferably anionic surfactants, nonionic surfactants and mixtures thereof.

More specifically, the granular detergent compositions of the present invention comprise from about 5% to about 80% of anionic surfactant, preferably from about 10% to about 70%, most preferably 15% to about 40% by weight.

Water-soluble salts of the higher fatty acids, i.e., soaps, are useful anionic surfactants in the compositions herein. Such salts include alkali metal soaps such as the sodium, potassium, ammonium, and alkylolammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_{12-18}$ carbon atoms) such as those produced by reducing the glycerides of tallow or coconut oil; and the sodium and potassium alkylbenzene sulfonates in which the alkyl group contains from about 10 to about 16 carbon atoms, in straight chain or branched chain configuration. See U.S. Pat. No. 2,220,099 and 2,477,383. Especially valuable are linear straight chain alkylbenzene sulfonates in which the average number of carbon atoms in the alkyl group is from about 11 to 14, abbreviated as $C_{11-14}$ LAS.

Especially preferred are mixtures of $C_{11-16}$ (preferably $C_{11-13}$) linear alkylbenzene sulfonates and $C_{12-18}$ (preferably $C_{14-16}$) alkyl sulfates. These are preferably present in a weight ratio of between 4:1 and 1:4, preferably about 3:1 to 1:3, alkylbenzene sulfonate:alkyl sulfate. Sodium salts of the above are preferred.

Other anionic surfactants useful herein are the sodium alkyl glyceryl ether sulfonates and water-soluble salts of esters of alpha-sulfonated fatty acids. Examples of these anionic surfactants are set forth in U.S. Pat. No. 5,565,422, Del Greco, issued Oct. 15, 1996.

The granular detergent compositions of the present invention useful herein may also comprise nonionic surfactant. Depending on the nonionic surfactant, the nonionic surfactant can be incorporated into the composition as an integral part of the spray dried granule and/or via the spraying step of the process herein. A portion of the nonionic surfactant can also be incorporated after mixing and/or grinding the granules.

Water-soluble nonionic surfactants are used in the instant detergent compositions. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 15 carbon atoms, in either a straight chain or branched chain configuration, with from about 3 to 80 moles of ethylene oxide per mole of alkyl phenol.

Included are the water-soluble and water-dispersible condensation products of aliphatic alcohols containing from 8 to 22 carbon atoms, in either straight chain or branched configuration, with from 3 to 12 moles of ethylene oxide per mole of alcohol.

Semi-polar nonionic surfactants include water-soluble amine oxides containing one alkyl moiety of from abut 10 to 18 carbon atoms and two moieties selected from the group of alkyl and hydroxyalkyl moieties of from about 1 to about 3 carbon atoms; water-soluble phosphine oxides containing one alkyl moiety of about 10 to 18 carbon atoms and two moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Preferred nonionic surfactants are of the formula $R^1(OC_2H_4)OH$, wherein $R^1$ is a $C_{10-16}$ alkyl group or a $C_{8-12}$ alkyl phenyl group, and n is from 3 to about 80.

Particularly preferred are condensation products of alcohols with from about 5 to about 20 moles of ethylene oxide per mole of alcohol, e.g., $C_{12-13}$ alcohol condensed with about 6.5 moles of ethylene oxide per mole of alcohol.

In a preferred embodiment, the nonionic surfactant is an ethoxylated surfactant derived from the reaction of a monohydroxy alcohol or alkylphenol containing from about 8 to about 20 carbon atoms, excluding cyclic carbon atoms, with from about 6 to about 15 moles of ethylene oxide per mole of alcohol or alkyl phenol on an average basis.

A particularly preferred ethoxylated nonionic surfactant is derived from a straight chain fatty alcohol containing from about 16 to about 20 carbon atoms ($C_{16-20}$ alcohol), preferably a $C_{18}$ alcohol, condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average.

The ethoxylated nonionic surfactant can optionally contain propylene oxide in an amount up to about 15% by weight of the surfactant and retain the advantages hereinafter described. Preferred surfactants of the invention can be prepared by the processes described in U.S. Pat. No. 4,223,163, Builloty, issued Sep. 16, 1980.

A highly preferred composition contains the ethoxylated monohydroxyalcohol or alkyl phenol and additionally comprises a polyoxyethylene, polyoxypropylene block polymeric compound; the ethoxylated monohydroxy alcohol or alkyl phenol nonionic surfactant comprising from about 20% to about 80%, preferably from about 30% to about 70%, of the total surfactant composition by weight.

Suitable block polyoxyethylene-polyoxypropylene polymeric compounds that meet the requirements described hereinbefore include those based on ethylene glycol, propylene glycol, glycerol, trimethylolpropane and ethylenediamine as the initiator reactive hydrogen compound. Polymeric compounds made from a sequential ethoxylation and propoxylation of initiator compounds with a single reactive hydrogen atom, such as $C_{12-18}$ aliphatic alcohols, do not provide satisfactory suds control in the detergent compositions of the invention. Certain of the block polymer surfactant compounds designated PLURONIC and TETRONIC by the BASF-Wyandotte Corp., Wyandotte, Mich., are suitable in the surfactant compositions of the invention.

A particularly preferred embodiment contains from about 40% to about 70% of a polyoxypropylene, polyoxyethylene block polymer blend comprising about 75%, by weight of the blend, of a reverse block co-polymer of polyoxyethylene and polyoxypropylene containing 17 moles of ethylene oxide and 44 moles of propylene oxide; and about 25%, by weight of the blend, of a block co-polymer of polyoxyethylene and polyoxypropylene, initiated with tri-methylol propane, containing 99 moles of propylene oxide and 24 moles of ethylene oxide per mole of trimethylol propane.

Because of the relatively high polyoxypropylene content, e.g., up to about 90% of the block polyoxyethylene-polyoxypropylene polymeric compounds of the invention and particularly when the polyoxypropylene chains are in the terminal position, the compounds are suitable for use in the surfactant compositions of the invention and have relatively low cloud points. Cloud points of 1% solutions in water are typically below about 32 degC and preferably from about 15 degC to about 30 degC for optimum control of sudsing throughout a full range of water temperatures and water hardnesses.

In addition, the anionic and nonionic surfactants required in the detergent compositions of the invention herein, the detergent compositions may also contain surfactants selected from the group of ampholytic, zwitterinoic, cationic surfactants and mixtures thereof.

Ampholytic surfactants include derivatives of aliphatic or aliphatic derivatives of heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic, quaternary, ammonium, phosphonium, and sulfonium compounds in which one of the aliphatic substituents contains from about 8 to 18 carbon atoms.

Cationic surfactants can also be included in the present detergent granules. Cationic surfactants comprise a wide variety of compounds characterized by one or more organic hydrophobic groups in the cation and generally by a quaternary nitrogen associated with an acid radical.

Pentavalent nitrogen ring compounds are also considered quaternary nitrogen compounds. Halides, methyl sulfate and hydroxide are suitable.

Tertiary amines can have characteristics similar to cationic surfactants at washing solution pH values less than about 8.5. A more complete disclosure of these and other cationic surfactants useful herein can be found in U.S. Pat. No. 4,228,044, Cambre, issued Oct. 14, 1980.

Cationic surfactants are often used in detergent compositions to provide fabric softening and/or antistatic benefits. Antistatic agents which provide some softening benefit and which are preferred herein are the quaternary ammonium salts described in U.S. Pat. No. 3,936,537, Baskerville, Jr. et al., issued Feb. 3, 1976. Useful cationic surfactants also include those described in U.S. Pat. No. 4,222,905, Cockrell, issued Sep. 16, 1980, and in U.S. Pat. No. 4,239,659, Murphy, issued Dec. 16, 1980.

(2) Builders

Builders are typically employed to sequester hardness ions and to help adjust the pH of the laundering liquid. Such builders present in the compositions up to about 85%, preferably from about 5% to about 50%, most preferably from about 10% to about 30% to provide their builder and pH-controlling functions. The builders herein include any of the conventional inorganic and organic water-soluble builder salts.

Such builders include water-soluble salts of phosphates, e.g., such as tripolyphosphates, pyrophosphates, orthophosphates, higher polyphosphates, other carbonates, silicates, and organic polycarboxylates. Specific preferred examples of inorganic phosphate builders include sodium and potassium tripolyphosphates and pyrophosphates.

Nonphosphorus-containing material may also be selected. Specific examples of nonphosphorus, inorganic detergent builder ingredients include water-soluble bicarbonate, and silicate salts. The alkali metal, e.g., sodium and potassium, bicarbonates, and silicates are particularly useful herein.

Aluminosilicate ion exchange materials useful in the practice of this invention are commercially available. The aluminosilicates useful in this invention can be crystalline or amorphous in structure and can be naturally-occurring aluminosilicates or synthetically derived. A method for producing aluminosilicate ion exchange materials is discussed in Krummel et al, U.S. Pat. No. 3,985,669, issued Oct. 12, 1976. Preferred synthetic crystalline aluminosilicate ion exchange materials useful herein are available under the designations Zeolite A, Zeolite B, and Zeolite X. In an especially preferred embodiment, the crystalline aluminosilicate ion exchange material in Zeolite A and has the formula $Na_{12}[(AlO_2)_{12}(SiO_2)_{12}]xH_2O$ wherein x is from about 20 to about 30, especially about 27. Other preferred builder include a mixture of a water-insoluble aluminosilicate builder such as zeolite A or of a layered silicate (e.g., SKS-6), and a water-soluble carboxylate chelating agent such as citric acid. Still other preferred builder include a mixture of a water-insoluble aluminosilicate builder such as zeolite A, and a watersoluble carboxylate chelating agent such as citric acid. Preferred builder systems for use in liquid detergent compositions of the present invention are soaps and polycarboxylates.

Water-soluble, organic builders are also useful herein. For example, the alkali metal, polycarboxylates are useful in the present compositions. Specific examples of the polycarboxylate builder salts include sodium and potassium, salts of ethylenediaminetetraacetic acid, nitrilotriacetic acid, oxydisuccinic acid, mellitic acid, benzene polycarboxylic acid, polyacrylic acid, and polymaleic acid. Other desirable polycarboxylate builders are the builders set forth in Diehl, U.S. Pat. No. 3,308,067, Examples of such materials include the water-soluble salts of homo- and co-polymers of aliphatic carboxylic acids such as maleic acid, itaconic acid, mesaconic acid, fumaric acid, aconitic acid, citraconic acid, and methylenemalonic acid.

Other suitable polymeric polycarboxylates are the polyacetal carboxylates described in Crutchfield et al, U.S. Pat. No. 4,144,226, issued Mar. 13, 1979, and U.S. Pat. No. 4,246,495, issued Mar. 27, 1979. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

The compositions herein preferably contain little (e.g., less than 10%, preferably less than 5%, by weight) or no phosphate builder materials. The presence of higher levels of tripolyphosphate improves solubility of the compositions to the point where hydrophobic amorphous silicate provides little or no additional improvements. However, sodium pyrophosphate reduces solubility so that the benefit provided by the hydrophobic amorphous silicate is greater in granular compositions containing pyrophosphate.

B. Coating Step

The second step for making a granular detergent composition of the present invention is applying an inorganic aqueous solution on the granules to substantially coat the granule obtained by the first step of the process.

Without being bound by theory, it is believed that surfactants, particularly nonionic surfactants, contained in detersive materials, tend to change to gel-like formation when exposed to humidity or when contacted with water in the washing solution. If the nonionic surfactant becomes gel-like, it may permeate coming out of the granule particles during processing of detergent compositions. If such gelled nonionic surfactants are coated to detesive material granular, the coating of gelled nonionic surfactants may perform as well (coating/masking the particles). Such gel-like formation which turns to a hard coating and covers the detersive material, may inhibit preventing the dissolution of the detersive material.

In another case, the gel-like formation makes the particles stick together to form large agglomerates. Such large agglomeration may also make difficulty of the dissolution of detergent particles.

It is believed that the inorganic aqueous solutions used in the present invention do not become gel-like when exposed to humidity, are not sticky and have good dissolution/dispersion property, therefore tending to smoothly dissolve when exposed in humidity, and overall facilitating dissolution the composition.

Preferably, the inorganic aqueous solution is applied by spraying on the surface of the granules prepared by the granulating step. The concentration of the inorganic solution is from about 0.5% to about 95%, preferably from 1.0% to about 50%.

Preferably, the inorganic aqueous solution is prepared by mixing one or more ingredients selected from the group consisting of sodium carbonate, sodium sulfate, potassium carbonate, potassium sulfate, sodium silicate, sodium hydroxide, potassium hydroxide, and mixtures thereof. The ingredient useful herein could be used as the builder described above.

The inorganic aqueous solution useful herein is applied in an amount of from about 0.5% to about 6.0% by the total weight of detergent components, preferably from about 1.0% to about 4.5%. The temperature of inorganic aqueous solution during coating step is from about 10° C. to about 100° C., preferably from about 30° C. to about 70° C.

The process for preparing a granular detergent composition may further comprise the step of applying a shell to the surface of the inorganic coated detergent granules. Herein, "shell" means a material which covers the granules of detersive material to preventing agglomeration of the particles. The detergent granules covered by shell can provide increased bulk density and reduced friction between particles; thus, the volume of the product can be reduced, providing a more compact product to the consumer. Preferably, the concentration of the shell is from about 2% to about 15%, preferably from about 3.0% to about 7.0%. The shell useful herein is selected from the group consisting of fine inorganic materials having a mean particle size less than about 5 $\mu$m, a micronized crystalline layered silicate (SKS-6 avairable from Hoechst Inc.,), a micronized carbonate, a micronized sodium sulphate, aluminosilicate (Zeolite), magnesium silicate, calcium silicate, and clay, preferably Zeolite.

It is believed that the adding the shell into inorganic aqueous solution or over the coating of inorganic solution tends to provide improved flowability. Preferably, the ratio of the inorganic aqueous solution to the shell is from about 0.2 to about 7.0.

Other Ingredients

Bleaching agents and activators additionally useful herein are described in U.S. Pat. No. 4,412,934, Chung et al., issued Nov. 1, 1983; U.S. Pat. No. 4,483,781, Hartman, issued Nov. 20, 1984; U.S. Pat. No. 4,634,551, Burns et al, issued Jan.

6, 1987; and U.S. Pat. No. 4,909,953, Sadlowski et al, issued Mar. 20, 1990. Chelating agents are described in U.S. Pat. No. 4,663,071, Bush et al. Suds modifiers are also optional ingredients and are described in U.S. Pat. 3,933,672, Bartoletta et al., issued Jan. 20, 1976; and U.S. Pat. No. 4,136,045, Gault et al., issued Jan. 23, 1979. Suitable smectite clays for use herein are described in U.S. Pat. No. 4,762,645, Tucker et al, issued Aug. 9, 1988. Suitable additional detergency builders for use herein are enumerated in U.S. Pat. No. 3,936,537, Baskerville, Jr. et al., issued Feb. 3, 1976, and in U.S. Pat. No. 4,663,071, Bush et al, issued May 5, 1987.

Other ingredients suitable for inclusion in a granular detergent composition can be added to the present compositions. These include bleach activators, suds boosters or suds suppressors, anti-tarnish and anticorrosion agents, soil suspending agents, soil release agents, germicides, pH adjusting agents, non-builder alkalinity sources, enzymes, enzyme-stabilizing agents and perfumes. Such ingredients are described in the Baskerville, Jr's U.S. Patent referred to the above.

EXAMPLES

The following examples further describe and demonstrate embodiments within the scope of the present invention. The examples are given solely for the purpose of illustration and are not to be construed as limitations of the present invention, as many variations thereof are possible without departing from the spirit and scope of the invention. Where applicable, ingredients are identified by chemical or CTFA name, or otherwise defined below.

In the detergent compositions, unless otherwise specified, the detergent ingredients are expressed by weight of the total compositions. The abbreviated component identifications therein have the following meanings:

| | |
|---|---|
| C12LAS | Sodium linear $C_{11-13}$ alkyl benzene sulphonate |
| C45FAS | Fatty alcohol sulfate (moisture level: 45.00%) |
| PEG 4000 | polyethyleneglycol of a M.W of 4000 |
| coco K3 | coco-alkyl methyl bis (hydroxyethyl) ammonium chloride |
| Brighteners/FWA 49 | Disodium 4,4'-bis(2-sulphostyryl)biphenyl. |
| Brighteners/FWA 3 | Disodium 4,4'-bis(4-anilino-6-morpholino-1.3.5-triazin-2-yl) stilbene-2:2'-disulfonate |
| Sodium Silicate (45% active) | Amorphous Sodium Silicate ($SiO_2$:$Na_2O$ ratio = 1.6–3.2). |
| Sodium Carbonate | Anhydrous sodium carbonate with a particle size between 200 and 900 micrometres. |
| Zeolite A | Hydrated Sodium Aluminosilicate of formula Na12(A1O2SiO2)12 27 H2O having a primary particle size in the range from 0.1 to 10 micrometers (Weight expressed on an anhydrous basis). |
| Enzymes | Protease, Amylase, Lipase, Cellulase |
| suds suppresser | 12% Silicone/silica, 18% stearyl alcohol, 70% starch in granular form. |
| soil release polymer | Soil Release Agents |
| Percarbonate | Anhydrous sodium percarbonate of nominal formula 2 $Na_2CO_{3.3}H_2O_2$. |
| NOBS | Nonanoyloxybenzene sulfonate in the form of the sodium salt. |
| SKS-6 | Crystalline layered silicate of formula *—$Na_2Si_2O_5$ |

Example A–D

These formulations are examples of inorganic aqueous solutions useful for coating the granular detergent materials herein.

| | A | B | C | D |
|---|---|---|---|---|
| C12LAS | 22.5 | 22.5 | 22.5 | 22.5 |
| C45FAS | 4.0 | 4.0 | 4.0 | 4.0 |
| PEG 4000 | 0.2 | 0.2 | 0.2 | 0.2 |
| polymers (45% active), | 14.9 | 14.9 | 14.9 | 14.9 |
| coco K3 | 1.3 | 1.3 | 1.3 | 1.3 |
| brigtners/FWA 49 | 0.2 | 0.2 | 0.2 | 0.2 |
| brigtners/FWA 3 | 0.1 | 0.1 | 0.1 | 0.1 |
| Sodium Silicate (45% active) | 12.9 | 12.9 | 12.9 | 12.9 |
| Sodium Carbonate | 11.6 | 11.6 | 11.6 | 11.6 |
| Zeolite A | 2.7 | 2.7 | 2.7 | 2.7 |
| Miscellaneous | 2.4 | 2.4 | 2.4 | 2.4 |
| Moisture | 4.3 | 4.3 | 4.3 | 4.3 |
| Zeolite A | 1.8 | 1.8 | 1.8 | 1.8 |
| 20% Sodium Carbonate solution | 2.0 | | | |
| 25% Sodium Carbonate solution | | 2.0 | | |
| 20% Sodium Sulfate solution | | | 2.00 | |
| 20% Potasium Carbonate | | | | 2.00 |
| Zeolite A | 5.0 | 5.0 | 5.00 | 5.00 |
| Perfume | 0.1 | 0.1 | 0.1 | 0.08 |
| Enzymes | 0.6 | 0.6 | 0.6 | 0.6 |
| suds suppresser | 0.9 | 0.9 | 0.9 | 0.9 |
| soil release polymer | 0.7 | 0.7 | 0.7 | 0.7 |
| Percarbonate | 3.1 | 3.1 | 3.1 | 3.1 |
| NOBS | 2.7 | 2.7 | 2.7 | 2.7 |
| SKS-6 | 6.0 | 6.0 | 6.0 | 6.0 |
| total | 100.0 | 100.0 | 100.0 | 100.0 |

Example E–H

These formulations are examples of combinations of inorganic solution coating and shell coating.

| | E | F | G | H |
|---|---|---|---|---|
| C12LAS | 22.5 | 22.5 | 22.5 | 22.5 |
| C45FAS | 4.0 | 4.0 | 4.0 | 4.0 |
| PEG 4000 | 0.2 | 0.2 | 0.2 | 0.2 |
| polymers (45% active), | 14.9 | 14.9 | 14.9 | 14.9 |
| coco K3 | 1.3 | 1.3 | 1.3 | 1.3 |
| brighteners/FWA 49 | 0.2 | 0.2 | 0.2 | 0.2 |
| brighteners/FWA 3 | 0.1 | 0.1 | 0.1 | 0.1 |
| Sodium Silicate (45% active), | 12.9 | 12.9 | 12.9 | 12.9 |
| Sodium Carbonate | 11.6 | 11.6 | 11.6 | 11.6 |
| Zeolite A | 2.7 | 2.7 | 2.7 | 2.7 |
| Miscellaneous | 2.4 | 2.4 | 2.4 | 2.4 |
| Moisture | 4.3 | 4.3 | 4.3 | 4.3 |
| Zeolite A | 1.8 | 1.8 | 1.8 | 1.8 |
| 20% Sodium Carbonate solution | 1.0 | 1.0 | 3.0 | 3.0 |
| Perfume | 0.1 | 0.1 | 0.1 | 0.1 |
| Zeolite A | 3.0 | 7.0 | 3.0 | 7.0 |
| SKS-6 | 9.0 | 5.0 | 7.0 | 3.0 |
| Enzymes | 0.6 | 0.6 | 0.6 | 0.6 |
| suds suppresser | 0.9 | 0.9 | 0.9 | 0.9 |
| soil release polymer | 0.7 | 0.7 | 0.7 | 0.7 |
| Percarbonate | 3.1 | 3.1 | 3.1 | 3.1 |
| NOBS | 2.7 | 2.7 | 2.7 | 2.7 |
| total | 100.0 | 100.0 | 100.0 | 100.0 |

The above described compositions are suitably made as follows:

(1) A detersive slurry material comprising an anionic surfactant such as C12LAS, C45FAS and PEG 4000 is prepared by sulfation dominant bath and neutralization loops.

(2) The slurry is mixed with polymers (45% active), Cationic surfactant such as Coco K3, brighteners such as FWA 49 and FWA 3, Sodium Silicate (45% active), Sodium Carbonate, and Zeolite A, completely.

(3) The detersive slurry is dried by a conventional spray dryer by an inlet temperature of about 300° C. and outlet temperature of about from 80° C. to about 100° C.

(4) The spray dried base powder exits the spray drying tower at temperature of about 100° C.

(5) The spray dried base powder is mixed with Zeolite A in a drum mixer for about 1~2 minutes.

(6) The mixture exposed from the end of the drum mixer to an airlift is compacted by a compacting machine. The bulk density of compacted chips is about 1.4 g/cc.

(7) Compacted chips are ground by Hammer mills and sieved by Sinto screen.

(8) Compacted chips are coated by inorganic solution such as Sodium Sulfate solution (conc. 20%). The coated chips may be further coated by Zeolite A in the Lodige mixers.

(9) Perfume is sprayed on a coated powder. Other ingredients (Enzymes, bleach, suds suppresser, soil release polymer) may be added as dry materials.

The embodiments disclosed and represented by the previous examples have many advantages. For example, the composition prepared by the present invention have improved water solubility in many conditions and improved physical properties such as flowability and high bulk density.

It is understood that the foregoing detailed description of examples and embodiments of the present invention are given merely by way of illustration, and that numerous modifications and variations may become apparent to those skilled in the art without departing from the spirit and scope of the invention; and such apparent modifications and variations are to be included in the scope of the appended claims.

What is claimed is:

1. A process for making a granular detergent composition comprising the steps of:

(a) granulating a detersive material comprising a detergent surfactant and a builder to provide granules;

(b) coating an inorganic aqueous solution selected from the group consisting of sodium carbonate, sodium sulfate, potassium carbonate, potassium sulfate, sodium hydroxide, potassium hydroxide, and mixtures thereof on the granules to substantially coat the granules; and (c) applying a zeolite shell to the coated granules obtained in step (b).

2. The process of claim 1, wherein step (b) comprises spraying the inorganic aqueous solution on the granules of step (a).

3. The process of claim 1, wherein the inorganic aqueous solution is present from about 0.5 to about 6% by weight of the composition.

4. The process of claim 1, wherein the detergent surfactant is selected from the group consisting of anionic surfactants, nonionic surfactants, zwitterionic surfactants, ampholytic surfactants, cationic surfactants, and mixtures thereof and comprises from about 5% to 80% by weight of the composition.

5. The process of claim 1, wherein step (a) includes spray-drying the detersive material so as to form spray-dried granules and grinding the spray-dried granules.

* * * * *